US009477199B2

(12) United States Patent
Shima

(10) Patent No.: US 9,477,199 B2
(45) Date of Patent: Oct. 25, 2016

(54) COLLECTING TONER CONTAINER AND IMAGE FORMING APPARATUS USING THE SAME

(71) Applicant: CANON KABUSHIKI KAISHA, Tokyo (JP)

(72) Inventor: Toshihide Shima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/942,093

(22) Filed: Nov. 16, 2015

(65) Prior Publication Data

US 2016/0170366 A1 Jun. 16, 2016

(30) Foreign Application Priority Data

Dec. 10, 2014 (JP) ..... 2014-249463

(51) Int. Cl.
*G03G 21/00* (2006.01)
*G03G 21/12* (2006.01)

(52) U.S. Cl.
CPC ..... *G03G 21/12* (2013.01)

(58) Field of Classification Search
CPC ..... G03G 21/10; G03G 21/105; G03G 21/12
See application file for complete search history.

(56) References Cited

U.S. PATENT DOCUMENTS

| | | | | |
|---|---|---|---|---|
| 8,929,796 | B2 | 1/2015 | Tojo | |
| 9,037,071 | B2 | 5/2015 | Shima | |
| 2009/0116853 | A1* | 5/2009 | Okazaki | G03G 21/12 399/12 |
| 2013/0216289 | A1 | 8/2013 | Tojo | |
| 2015/0003881 | A1 | 1/2015 | Shima | |

FOREIGN PATENT DOCUMENTS

| | | | |
|---|---|---|---|
| JP | 2009-300635 | A | 12/2009 |
| JP | 5233429 | B2 | 7/2013 |
| JP | 2013-167839 | A | 8/2013 |

* cited by examiner

*Primary Examiner* — Walter L Lindsay, Jr.
*Assistant Examiner* — Ruifeng Pu
(74) *Attorney, Agent, or Firm* — Fitzpatrick, Cella, Harper & Scinto

(57) ABSTRACT

Provided are a collecting toner container that is detachably attached to a main body of an image forming apparatus so as to collect and store toner; an opening portion through which toner flows from the main body of the image forming apparatus into the collecting toner container; and a stirring/conveying member that conveys the toner flowing from the opening portion into the collecting toner container in the downstream direction of the collecting toner container, wherein a discharge opening used to discharge the toner inside the collecting toner container is formed in each of two adjacent surfaces as a bottom surface and a side surface of the collecting toner container, and the discharge openings provided in the respective surfaces are formed so as to share a ridge line portion of the two surfaces.

7 Claims, 8 Drawing Sheets

COLLECTING TONER CONTAINER AND IMAGE FORMING APPARATUS USING THE SAME

BACKGROUND OF THE INVENTION

1. Field of the Invention

The present invention relates to a collecting toner container detachably attached to an image forming apparatus such as a printer, a copying machine, and a facsimile using an electrophotographic system.

2. Description of the Related Art

In an electrophotographic image forming apparatus, a collecting toner container recovers developer degraded in a developing device or non-transferred toner scrapped from a photoconductive drum or an intermediate transfer member by a cleaning portion. Then, when the collecting toner amount reaches a predetermined amount, the collecting toner container is replaced by an empty container.

It is desirable that the collecting toner container recover the toner or the developer as much as possible. In recent years, a method of reusing the collecting toner container usually discarded after replacement has been examined due to a demand for the effective utilization of resources. In order to reuse the collecting toner container, there is a need to discharge the collecting toner and to clean the collecting toner container.

Here, Japanese Patent Laid-Open No. 2009-300635 discloses a collecting toner container that efficiently discharges collecting toner therein without any toner flying around the collecting toner container to be reused. In Japanese Patent Laid-Open No. 2009-300635, a discharge opening through which the collecting toner flows is disposed separately from the main body of the image forming apparatus, and a screw is formed toward the discharge opening. During the cleaning operation of the collecting toner container, the screw is rotated so as to discharge the collecting toner from the discharge opening. Accordingly, it is possible to discharge the toner fixed into the collecting toner container while crushing the toner.

In U.S. Patent Application Publication No. 2013/216289 A1, an opening is provided so as to discharge collecting toner inside the container, and a lid member blocking the opening also serves as a bearing portion of a conveying screw inside a collecting toner container. Accordingly, it is possible to reliably prevent a problem in which the screw and the bearing portion are blocked by the collecting toner during the cleaning operation of the collecting toner container.

In order to decrease the number of times of the maintenance of the collecting toner container, the collecting toner container needs to be increased in size or the collecting toner charging amount inside the collecting toner container needs to be increased. In this case, a large amount of the collecting toner is collected inside one collecting toner container.

For this reason, it takes time when the collecting toner is discharged or the collecting toner container is cleaned in order to reuse the collecting toner container. For example, in Japanese Patent Laid-Open No. 2009-300635 and U.S. Patent Application Publication No. 2013/216289 A1, the screw is rotated so as to discharge the collecting toner inside the collecting toner container. Since the discharge opening is provided only in one surface of the collecting toner container, it takes time when the collecting toner is discarded.

Here, it is desirable to provide a collecting toner container capable of efficiently discharging collected toner.

SUMMARY OF THE INVENTION

According to the representative configuration of a collecting toner container of the invention, the collecting toner container includes: a storage portion which collects and stores the toner; an inflow opening through which the toner flows from the image forming apparatus to the storage portion; a conveying portion which conveys the toner inside the storage portion; and a discharge opening which is provided in each of two adjacent surfaces of the storage portion so as to discharge the toner inside the storage portion, wherein the discharge openings provided in the respective surfaces are formed so as to share a ridge line portion of the two surfaces.

Further features of the present invention will become apparent from the following description of exemplary embodiments with reference to the attached drawings.

DESCRIPTION OF THE EMBODIMENTS

Figure 1:
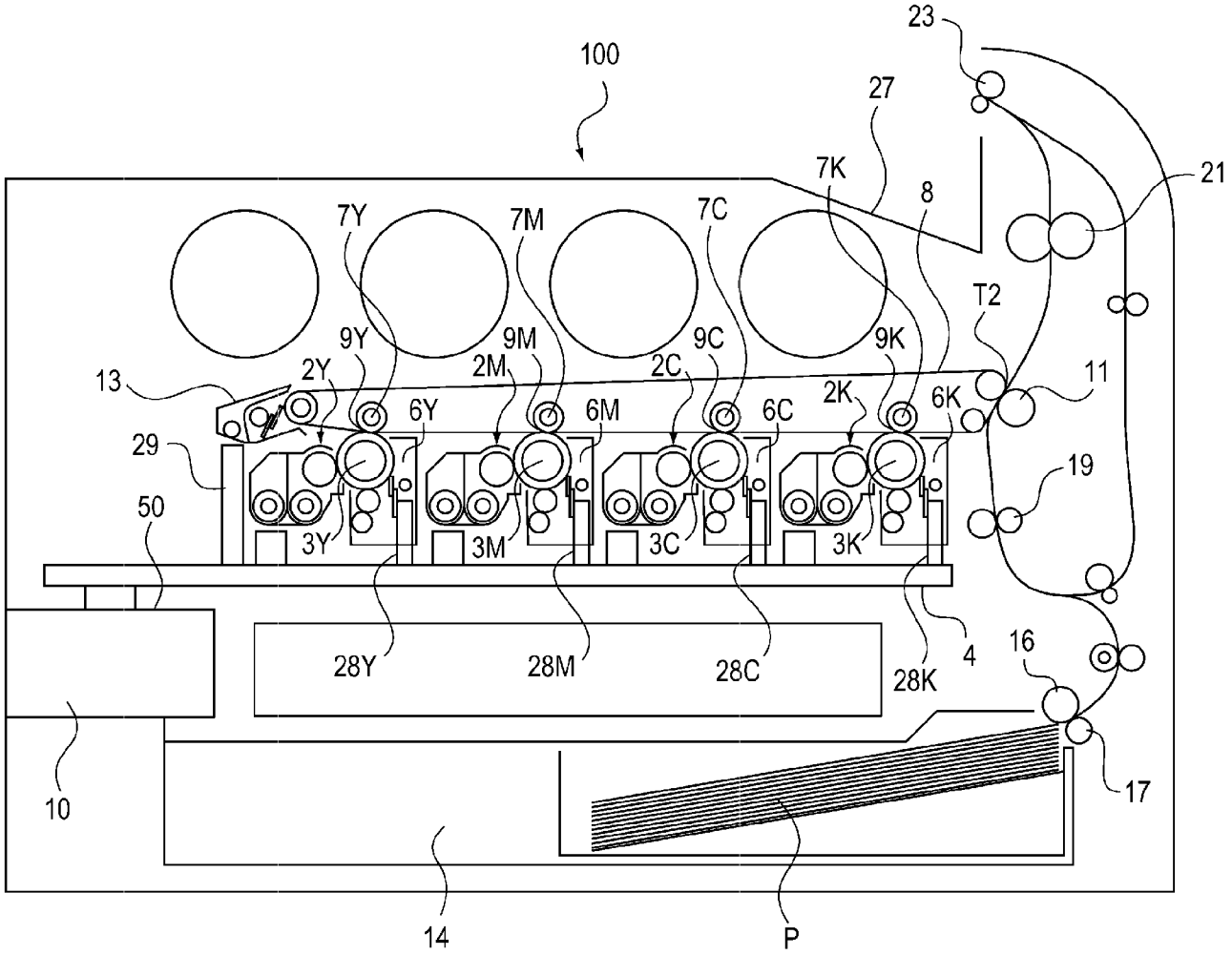
FIG. 1 is a cross-sectional view illustrating the configuration of an image forming apparatus with a detachably attachable collecting toner container according to the invention.

Referring to the drawings, an image forming apparatus with a detachably attachable collecting toner container according to an embodiment of the invention will be described in detail. However, the invention is not limited to the dimension, the material, the shape, and the relative arrangement of the component described in the embodiments below.

First Embodiment

First, the configuration of an image forming apparatus with a detachably attachable collecting toner container according to a first embodiment of the invention will be described with reference to FIGS. 1 to 5B and FIG. 8A.

<Image Forming Apparatus>

FIG. 1 is a cross-sectional view illustrating the configuration of an image forming apparatus 100 with a detachably attachable collecting toner container 10 according to the invention. In the image forming apparatus 100 illustrated in FIG. 1, an intermediate transfer belt 8 as an intermediate transfer member is stretched in the horizontal direction (the left and right direction of FIG. 1). Four image forming portions 2Y, 2M, 2C, and 2K of yellow Y, magenta M, cyan C, and black K are arranged in the stretched direction of the intermediate transfer belt 8 (a tandem type full-color printer).

In addition, in the description below, the image forming portions 2Y, 2M, 2C, and 2K may be only representatively described as an image forming portion 2. The same applies to the other image forming process portions.

At the image forming portion 2Y which is disposed at the most upstream side of the intermediate transfer belt 8 in the rotation direction, a yellow toner image is formed on an upper surface of a photoconductive drum 3Y as an image bearing member by a known image forming process. Subsequently, the toner image is primarily transferred onto the outer peripheral surface of the intermediate transfer belt 8 in a primary transfer roller 7Y which serves as a primary transfer portion disposed on the inner peripheral surface of the intermediate transfer belt 8 and a primary transfer portion 9Y which faces the photoconductive drum 3Y with the intermediate transfer belt 8 interposed therebetween.

The primary non-transferred toner which remains on the surface of the photoconductive drum 3Y after the primary transfer operation is removed as the collecting toner t by a drum cleaning device 6Y as a cleaning portion.

Similarly, a magenta toner image is formed on the surface of the photoconductive drum 3M in the image forming portion 2M. Subsequently, the magenta toner image is primarily transferred onto the yellow toner image on the outer peripheral surface of the intermediate transfer belt 8 in a primary transfer portion 9M in a superimposed state.

The primary non-transferred toner which remains on the surface of the photoconductive drum 3M after the primary transfer operation is removed as the collecting toner t by a drum cleaning device 6M.

Similarly, a cyan toner image and a black toner image are respectively formed on the surfaces of the photoconductive drums 3C and 3K in the image forming portions 2C and 2K. Subsequently, the toner images are respectively primarily transferred onto the outer peripheral surface of the intermediate transfer belt 8 in primary transfer portions 9C and 9K.

The primary non-transferred toner which remains on the surfaces of the photoconductive drums 3C and 3K after the primary transfer operation is respectively removed as the collecting toner t by drum cleaning devices 6C and 6K.

Four colors of toner images which are sequentially primary transferred onto the outer peripheral surface of the intermediate transfer belt 8 are conveyed to a secondary transfer portion T2 which faces a secondary transfer roller 11 as a secondary transfer portion. Meanwhile, a recording material P stored in a sheet tray 14 is fed one by one by a feeding roller 16 and a retard roller 17, and the recording material P is conveyed to the secondary transfer portion T2 so as to match the position of the toner image on the outer peripheral surface of the intermediate transfer belt 8 by a registration roller 19.

Then, the toner image on the outer peripheral surface of the intermediate transfer belt 8 is secondarily transferred onto the recording material P at the same time by the action of the secondary transfer roller 11. The recording material P to which the toner image is secondarily transferred is heated and pressed by a fixing device 21 as a fixing portion so that the toner image is fixed onto the recording material P. The recording material P having the toner image fixed thereonto is nipped and conveyed by a discharge roller 23 and is discharged onto a discharge tray 27.

Meanwhile, the non-transferred toner which remains on the outer peripheral surface of the intermediate transfer belt 8 after passing the secondary transfer portion T2 is removed by a belt cleaning device 13 as a cleaning portion.

Figure 2A:
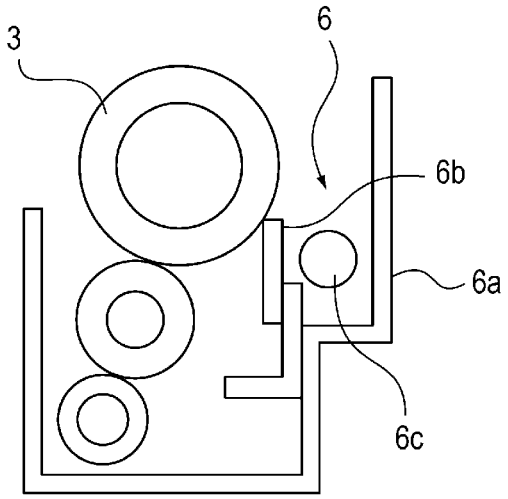
FIG. 2A is a cross-sectional view illustrating the configuration of a cleaning device that cleans a surface of an image bearing member.

As illustrated in FIG. 2A, the drum cleaning device 6 which is provided in each of the image forming portions 2Y, 2M, 2C, and 2K includes a cleaning container 6*a*. Further, the drum cleaning device 6 includes a cleaning blade 6*b* which is provided inside the cleaning container 6*a* in the long-side direction of the cleaning container 6*a* (in a direction from the rear side to the front side of the drawing paper of FIG. 2A). Furthermore, the drum cleaning device 6 includes a conveying screw 6*c*.

The cleaning blade 6*b* is formed as an elastic blade of which an edge contacts in the counter direction the surface of the photoconductive drum 3 rotating in the clockwise rotation direction of FIG. 2A. During the rotation of the photoconductive drum 3, the surface of the photoconductive drum 3 is scrubbed by the cleaning blade 6*b*. Accordingly, the primary non-transferred toner on the surface of the photoconductive drum 3 is scrapped into the cleaning container 6*a*.

The primary non-transferred toner which is scrapped by the cleaning blade 6*b* is conveyed inside the cleaning container 6*a* in the long-side direction of the cleaning container 6*a* (a direction from the rear side to the front side of the drawing paper of FIG. 2A) by the rotation of the conveying screw 6*c*. Accordingly, the primary non-transferred toner is conveyed from a toner discharge opening 28 illustrated in FIG. 1 and provided on the front side of the drawing paper of FIG. 2A of the cleaning container 6*a* into a collecting toner conveying pipe 4 as a collecting toner conveying portion.

Figure 2B:
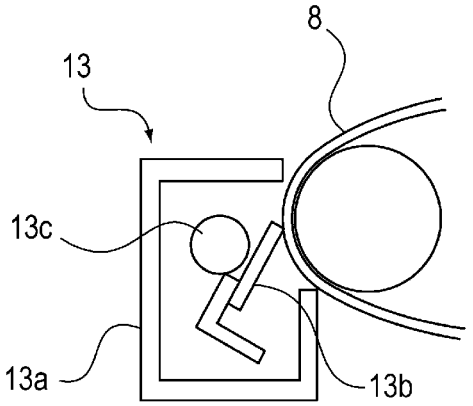
FIG. 2B is a cross-sectional view illustrating the configuration of the cleaning device that cleans an outer peripheral surface of an intermediate transfer member.

In the embodiment, the belt cleaning device 13 is also of a blade type that scrubs the outer peripheral surface of the intermediate transfer belt 8 by a cleaning blade 13*b* illustrated in FIG. 2B. As illustrated in FIG. 2B, the belt cleaning device 13 includes a cleaning container 13*a*. Further, the belt cleaning device 13 includes a cleaning blade 13*b* which is provided inside the cleaning container 13*a* in the long-side direction of the cleaning container 13*a* (a direction from the rear side to the front side of the drawing paper of FIG. 2B). Furthermore, the belt cleaning device 13 includes a conveying screw 13*c*.

The cleaning blade 13*b* is formed as an elastic blade of which an edge contacts in the counter direction the outer peripheral surface of the intermediate transfer belt 8 rotating in the counter-clockwise rotation direction of FIG. 2B. During the rotation of the intermediate transfer belt 8, the outer peripheral surface of the intermediate transfer belt 8 is scrubbed by the cleaning blade 13*b*. Accordingly, the secondary non-transferred toner on the outer peripheral surface of the intermediate transfer belt 8 is scrapped into the cleaning container 13*a*.

The secondary non-transferred toner which is scrapped by the cleaning blade 13*b* is conveyed inside the cleaning container 13*a* in the long-side direction of the cleaning container 13*a* (a direction from the rear side to the front side of the drawing paper of FIG. 2B) by the rotation of the conveying screw 13*c*. Then, the secondary non-transferred toner is conveyed from a toner discharge opening 29 illustrated in FIG. 1 and provided on the front side of the drawing paper of FIG. 2B of the cleaning container 13*a* into the collecting toner conveying pipe 4.

The collecting toner t is discharged from the toner discharge openings 28 and 29 illustrated in FIG. 1 of the cleaning containers 6*a* and 13*a* illustrated in FIGS. 2A and 2B. Then, the collecting toner t is conveyed into the collecting toner conveying pipe 4. Further, the collecting toner t is conveyed inside the collecting toner conveying pipe 4 toward the collecting toner container 10 by the rotation of a conveying screw (not illustrated) provided inside the collecting toner conveying pipe 4 and is collected inside the collecting toner container 10.

The collecting toner container 10 that serves as a container collecting (recovering and storing) the toner is detachably attached to a storage portion 50 of the main body of the image forming apparatus 100 illustrated in FIG. 1. When the amount of the toner collected inside the collecting toner container 10 (the container) reaches a predetermined amount, the collecting toner container 10 is extracted from the storage portion 50 and is replaced by an empty collecting toner container 10.

Figure 3:
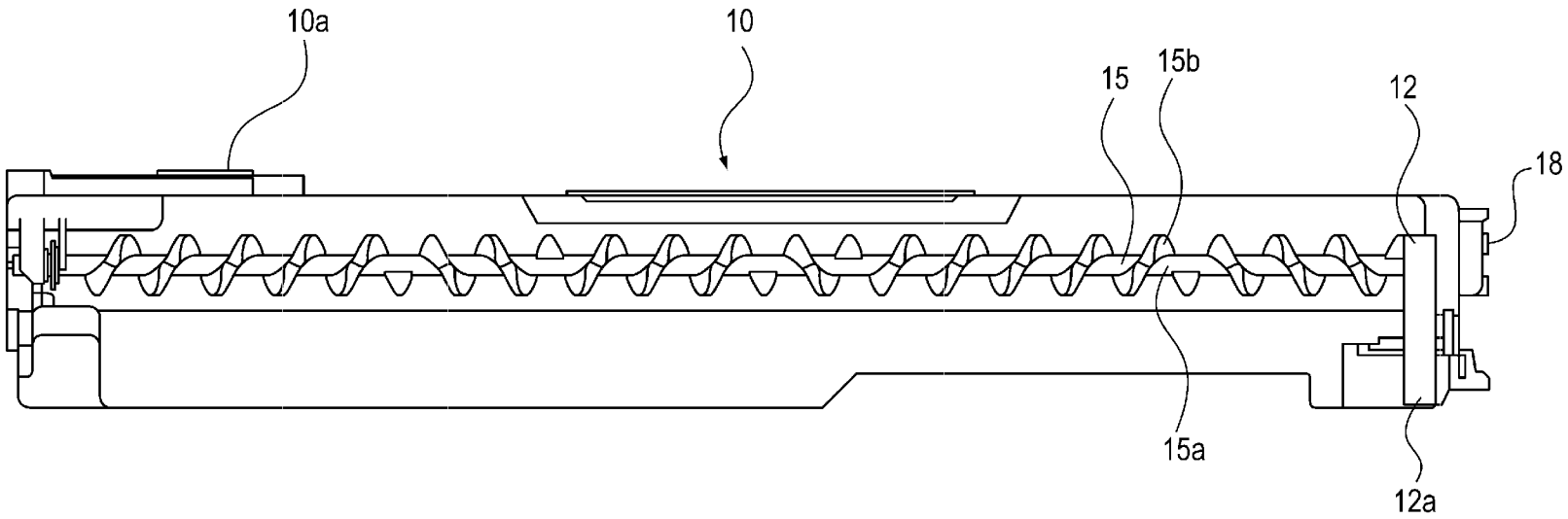
FIG. 3 is a cross-sectional view illustrating the configuration of the collecting toner container according to the invention.

FIG. 3 is a cross-sectional view illustrating the configuration of the collecting toner container 10. As illustrated in FIG. 3, the collecting toner container 10 is formed in, for example, a rectangular parallelepiped shape by soft plastic. The collecting toner container 10 includes an opening portion 10*a* that serves as an inflow opening provided at one end side of the upper surface wall portion (the left side of FIG. 3) illustrated in FIG. 3 so as to cause the collecting toner t to flow from the discharge opening of the collecting toner conveying pipe 4 provided in the main body of the image forming apparatus 100 into the collecting toner container 10.

The opening portion 10*a* is provided with a shutter (not illustrated) which moves in an openable and closeable manner in synchronization with the attachment/detachment of the collecting toner container 10 with respect to the storage portion 50.

The collecting toner t which flows from the opening portion 10*a* into the collecting toner container 10 is conveyed in the downstream direction (the right direction of FIG. 3) inside the collecting toner container 10 by a stirring/conveying member 15 as a conveying portion rotatably provided inside the collecting toner container 10. The collecting toner t which flows into the collecting toner container 10 is charged into the collecting toner container 10 while the powder surface of the collecting toner t is flattened by the rotation of the stirring/conveying member 15 formed as a screw member in which a spiral blade 15*b* is provided in an outer periphery of a rotation shaft 15*a*.

The stirring/conveying member 15 of the embodiment is formed in, for example, a screw shape by plastic, and is axially supported between one end side (the left side of FIG. 3) and the other end side (the right side of FIG. 3) of the collecting toner container 10 so as to be rotatable substantially horizontally.

Figure 4:
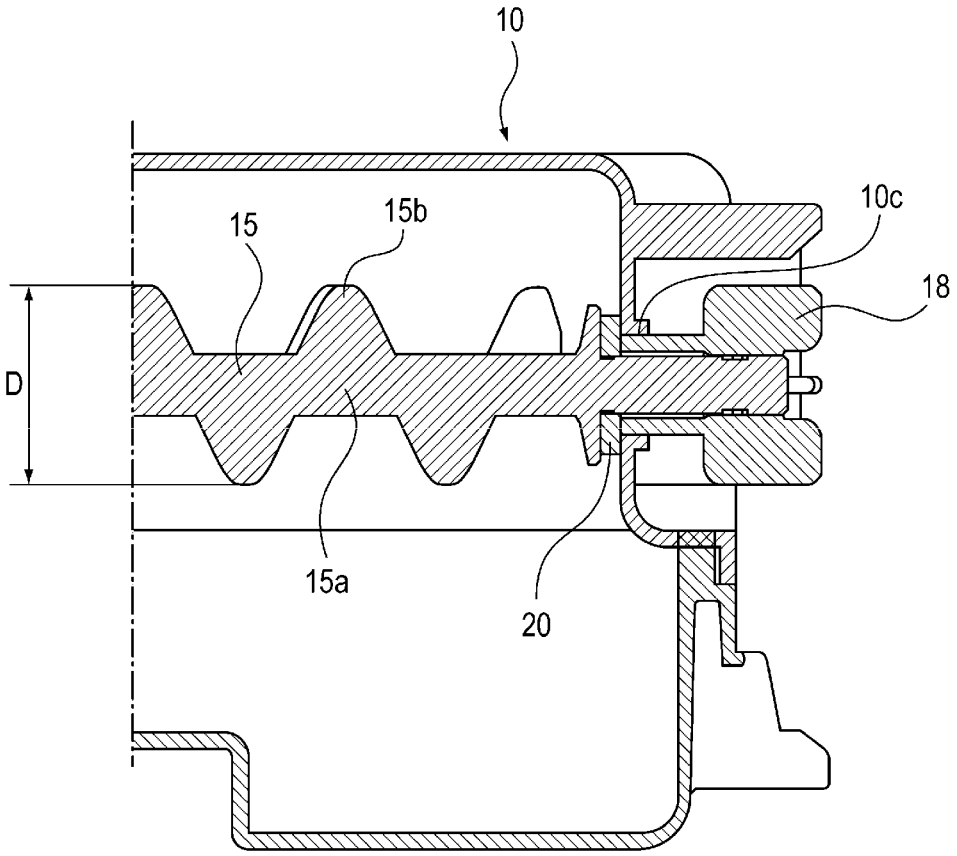
FIG. 4 is a partially cross-sectional view illustrating the configuration of the collecting toner container according to the invention.

As illustrated in FIG. 4, one end (the right end of FIG. 4) of the rotation shaft 15*a* of the stirring/conveying member 15 protrudes outward from the collecting toner container 10. A coupling member 18 that serves as a driving connection portion is fitted and locked to the outer peripheral end of the rotation shaft 15*a* protruding outward from the collecting toner container 10. When the coupling member 18 receives a rotational driving force transmitted from a motor as a driving source (not illustrated) provided in the main body of the image forming apparatus 100 and is rotationally driven, the stirring/conveying member 15 is rotationally driven.

FIG. 4 is a partially cross-sectional view illustrating the configuration in the periphery of the coupling member 18 that serves as the driving connection portion of the collecting toner container 10. As illustrated in FIG. 4, the coupling member 18 that serves as the driving connection portion formed of a material different from the stirring/conveying member 15 is fitted and locked to the outer peripheral end of the rotation shaft 15*a* of the stirring/conveying member 15.

The stirring/conveying member 15 of the embodiment is formed of ABS (Acrylonitrile Butadiene Styrene copolymer) resin. Meanwhile, the coupling member 18 is formed of POM (Polyoxymethylene) having high sliding property.

The coupling member 18 is slidably fitted and locked to the rotation shaft 15*a* of the stirring/conveying member 15. Accordingly, a problem such as abrasion hardly occurs in the rotation shaft 15*a*. The coupling member 18 is rotatably and axially supported to a bearing portion 10*c* provided in the side surface of the collecting toner container 10. When the rotation shaft 15*a* of the stirring/conveying member 15 is rotatably and axially supported to the bearing portion 10*c* provided in the side surface of the collecting toner container 10 through the coupling member 18 having a high sliding property, there is no need to replace a component when the collecting toner container 10 is reused.

Further, a seal member 20 is provided at the inside of the collecting toner container 10 of the bearing portion of the rotation shaft 15*a* of the stirring/conveying member 15. Accordingly, the collecting toner t hardly intrudes into the bearing portion 10*c* of the coupling member 18 locked to the rotation shaft 15*a* of the stirring/conveying member 15. Accordingly, the collecting toner t hardly intrudes into the bearing portion 10*c* of the coupling member 18 locked to the rotation shaft 15*a* of the stirring/conveying member 15 when the collecting toner t inside the collecting toner container 10 is removed to reuse the collecting toner container 10 and the inside of the collecting toner container 10 is cleaned.

Figure 5A:
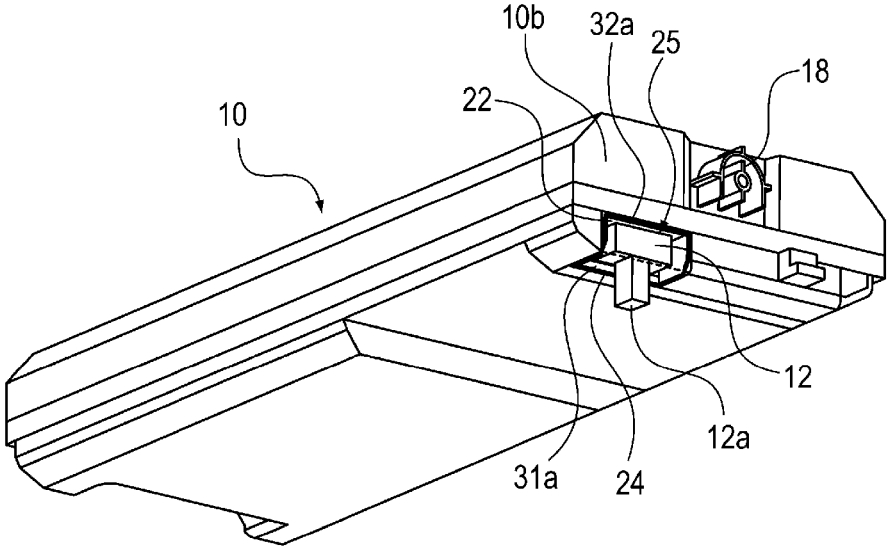
FIG. 5A is a perspective view illustrating the configuration in the periphery of a discharge opening of a collecting toner container according to a first embodiment of the invention.

Further, a collecting toner amount detector 12 is provided in the outer end side (the right end side of FIG. 3) when the opening portion 10*a* of the collecting toner container 10 is viewed from one end side (the left end side of FIG. 3) in the long-side direction of the collecting toner container 10 (the left and right direction of FIG. 3). As illustrated in FIGS. 3 and 5A, the collecting toner amount detector 12 is configured as a detector that includes a transparent convex portion 12*a* protruding toward the outside of the collecting toner container 10.

The convex portion 12*a* of the collecting toner amount detector 12 is formed as a transparent container having an inner space, and the inner space of the convex portion 12*a* communicates with the inner space of the collecting toner container 10. Accordingly, the collecting toner t which is collected in the collecting toner container 10 also flows into the inner space of the convex portion 12*a*.

Figure 6:
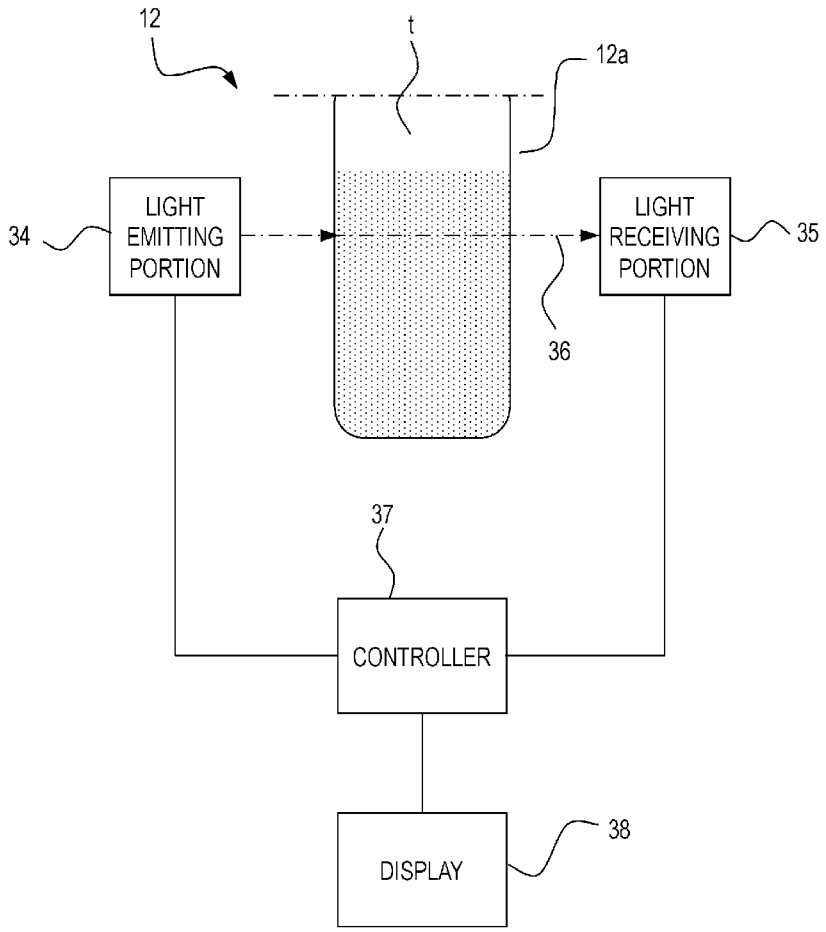
FIG. 6 is a block diagram illustrating the configuration of a control system of a detector according to the first embodiment.

The convex portion 12*a* of the collecting toner amount detector 12 is disposed on the optical path between a light emitting portion 34 and a light receiving portion 35 illustrated in FIG. 6 and provided in the main body of the image forming apparatus 100. Then, the light 36 emitted from the light emitting portion 34 is transmitted through the convex portion 12*a*. Alternatively, the light 36 emitted from the light emitting portion 34 is interrupted by the collecting toner t inside the collecting toner container 10 intruding into the convex portion 12*a* (the detector).

When the light 36 reaches the light receiving portion 35, the light receiving portion 35 is turned on. Meanwhile, when the light emitted from the light emitting portion 34 is interrupted by the collecting toner t inside the convex portion 12*a* so that the light does not reach the light receiving portion 35, the light receiving portion 35 is turned off.

The detection signal of the light receiving portion 35 is transmitted to a controller 37 as a control unit illustrated in FIG. 6 and provided in the main body of the image forming apparatus 100. Accordingly, the existence (the collecting toner amount) of the collecting toner inside the collecting toner container 10 can be detected by the collecting toner amount detector 12.

The controller 37 which is provided in the main body of the image forming apparatus 100 determines that the collecting toner amount inside the collecting toner container 10 reaches a predetermined amount based on the detection signal of the light receiving portion 35. Then, a message for requesting the replacement of the collecting toner container 10 is displayed on a display 38 of an operation panel provided in the main body of the image forming apparatus 100.

As illustrated in FIG. 3, the opening portion 10*a* as the inflow opening is provided so that the collecting toner t flows from the discharge opening of the collecting toner conveying pipe 4 provided in the main body of the image forming apparatus 100 illustrated in FIG. 1 into the collecting toner container 10. Further, the collecting toner amount detector 12 is provided so as to detect the powder surface of the collecting toner t collected into the collecting toner container 10.

Then, the opening portion 10*a* and the collecting toner amount detector 12 are separated from each other in the long-side direction of the collecting toner container (the left and right direction of FIG. 3). Accordingly, it is possible to prevent an erroneous detection caused by the light receiving portion 35 when the optical path passing through the convex portion 12*a* of the collecting toner amount detector 12 is polluted by the collecting toner t flying in the vicinity of the opening portion 10*a* so that the light 36 is interrupted.

The collecting toner amount detector 12 needs to be reliably cleaned when the collecting toner container 10 is reused. For example, there is a case in which the collecting toner t adheres to the convex portion 12*a* of the collecting toner amount detector 12.

Then, even when the collecting toner t does not exist inside the collecting toner container 10 to be reused, the optical path passing through the convex portion 12*a* is polluted by the collecting toner t adhering to the convex portion 12*a* so that the light 36 is interrupted. Accordingly, an erroneous detection is caused by the light receiving portion 35. Thus, there is a concern that the replacement period of the collecting toner container 10 may be erroneously detected.

In the embodiment, as illustrated in FIG. 5A, the lower surface of the collecting toner container 10 is provided with an opening 25 (a first opening) used for the attachment of the collecting toner amount detector 12. Further, a discharge opening 24 (a second opening) is provided in the side surface (the wall surface slightly close to the center in relation to a wall surface 10*b* as the outermost surface of the collecting toner container 10) of the collecting toner container 10 in the long-side direction (the left and right direction of FIG. 5A). The collecting toner t is discharged from the discharge opening 24 into the collecting toner container 10.

Figure 5B:
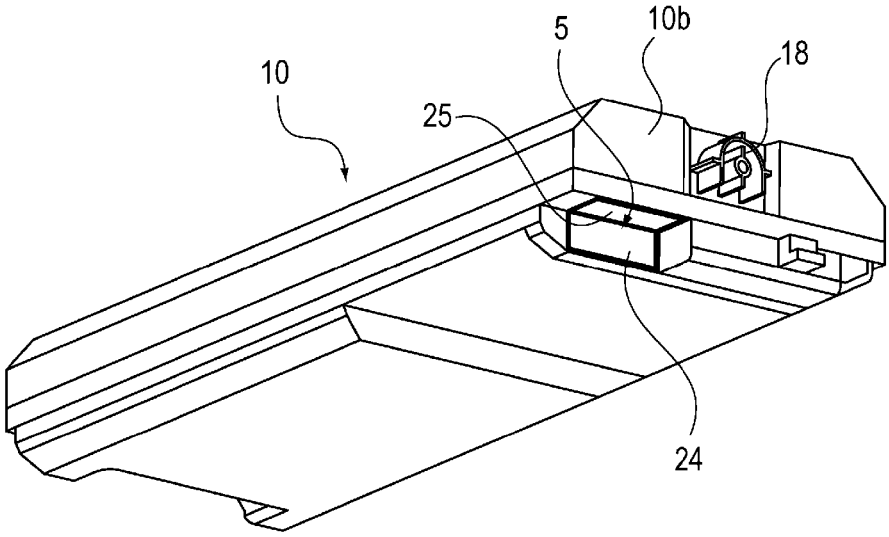
FIG. 5B is a perspective view illustrating the configuration in the periphery of the discharge opening of the collecting toner container according to the first embodiment of the invention.

As illustrated in FIGS. 5A and 5B, a discharge opening 5 through which the toner t inside the collecting toner container 10 (the container) of the embodiment is discharged is provided at each of two adjacent surfaces as the lower surface and the side surface of the collecting toner container 10. The discharge opening 5 includes the opening 25 (the first opening) which is provided in the lower surface of the collecting toner container 10 and the discharge opening 24 (the second opening) provided in the side surface (the wall surface slightly close to the center in relation to the wall surface 10*b* as the outermost surface of the collecting toner container 10) of the collecting toner container 10.

The opening 25 (the first opening) and the discharge opening 24 (the second opening) respectively provided in two adjacent surfaces as the lower surface and the side surface of the collecting toner container 10 have the following configuration. The two surfaces are formed so as to share the ridge line portion thereof (the ridge line portion of the lower surface and the side surface), and both surfaces communicate with the inner space of the collecting toner container 10.

As illustrated in FIG. 5B, the collecting toner amount detector 12 as the detector that detects the amount of the toner t (the toner amount) inside the collecting toner container 10 (the container) detachably attached to the opening 25 (the first opening) is separated. Accordingly, the collecting toner t inside the collecting toner container 10 can be also discharged from the opening 25 (the first opening).

Figure 8A:
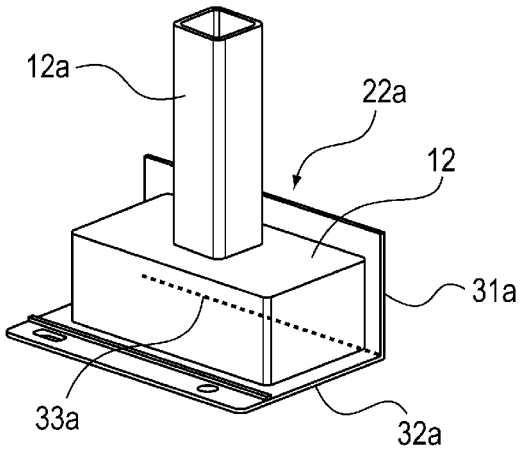
FIG. 8A is a perspective view illustrating the configuration of a lid member of the collecting toner container according to the first and second embodiments of the invention.

In the embodiment, the discharge opening 24 (the second opening) is blocked by a side surface plate 31*a* of the lid member 22*a* illustrated in FIG. 8A. As illustrated in FIG. 8A, the lid member 22*a* and the collecting toner amount detector 12 are integrated with each other. As illustrated in FIG. 5A, the discharge opening 24 (the second opening) of the embodiment is opened to the side surface (the wall surface slightly close to the center in relation to the wall surface 10*b* as the outermost surface of the collecting toner container 10) of the collecting toner container 10 in the long-side direction (the left and right direction of FIG. 5A).

Further, as illustrated in FIG. 5A, the discharge opening 24 (the second opening) is disposed at the lower side of FIG. 5A in relation to the opening 25 (the first opening) to which the collecting toner amount detector 12 is detachably attached. In addition, the discharge opening (the second opening) may be formed so as to share the ridge line portion of the two surfaces in the wall surface 10*b* illustrated in FIG.

5A and located above the opening 25 (the first opening) to which the collecting toner amount detector 12 is detachably attached, and may communicate with the inner space of the collecting toner container 10.

In the embodiment, as illustrated in FIG. 8A, the lid member 22*a* and the collecting toner amount detector 12 are integrated with each other. The lid member 22*a* is separated from the discharge opening 24 and the opening 25. Then, as illustrated in FIG. 5B, the discharge opening 24 (the second opening) is connected to the opening 25 (the first opening) provided so as to share the ridge line portion of two adjacent surfaces including the lower surface and the side surface (the ridge line portion of the lower surface and the side surface) of the collecting toner container 10. Accordingly, the first discharge opening 5 as a large opening is formed.

Accordingly, it is possible to improve the discharging efficiency for the collecting toner t inside the collecting toner container 10 and the cleaning efficiency for the collecting toner container 10 when the collecting toner container 10 is reused. Further, since the lid member 22*a* and the collecting toner amount detector 12 are integrated with each other, it is possible to decrease the number of components separated for disassembling and cleaning the collecting toner container 10 and to shorten the working time.

Next, a discharging process and a cleaning process for the collecting toner t collected inside the collecting toner container 10 when the collecting toner container 10 is reused will be described. First, as a first step, the collecting toner t inside the collecting toner container 10 is stirred. As a specific operation, the collecting toner container 10 is shaken. The collecting toner t collected into the collecting toner container 10 is charged into the collecting toner container 10 so that the collecting toner is pressed and hardened. Since the collecting toner container 10 is shaken, the collecting toner t inside the collecting toner container 10 is mixed with air. Accordingly, the mobility of the collecting toner t inside the collecting toner container 10 can be temporarily increased.

Next, as a second step, the lid member 22*a* integrated with the collecting toner amount detector 12 is separated from the main body of the collecting toner container 10. At this time, the discharge opening 24 communicating with the inner space of the collecting toner container 10 is exposed and the opening 25 attached with the collecting toner amount detector 12 is exposed. The opening 25 communicates with the inner space of the collecting toner container 10. As illustrated in FIG. 5A, the discharge opening 24 and the opening 25 are provided so as to be adjacent to each other. For this reason, as illustrated in FIG. 5B, the first discharge opening 5 in which the discharge opening 24 and the opening 25 are connected to each other is exposed.

For example, a case will be described in which the lid member 22*a* and the collecting toner amount detector 12 are not integrated with each other. Then, there is a need to separate two components as the lid member 22*a* and the collecting toner amount detector 12 when the collecting toner container 10 is cleaned to reuse the collecting toner container 10. As a result, the working time for separating the components from the main body of the collecting toner container 10 increases.

Next, as a third step, the collecting toner t is discharged from the discharge opening 24. Next, as a fourth step, the inside of the collecting toner container 10 is cleaned by the blowing and suctioning operation through the discharge opening 24. Regarding the cleaning process for the collecting toner container 10, it is assumed that the cleaning process is completed when the collecting toner t is not discharged from the discharge opening 24 at all in the case where the collecting toner container 10 is shaken. Next, as a fifth step, the lid member 22*a* and the collecting toner amount detector 12 separated in the second step are cleaned, and are attached to the main body of the collecting toner container 10 again.

Here, an example of actual measurement for the working time from the first step to the fifth step will be described. In the first step, the collecting toner t inside the collecting toner container 10 is stirred by shaking the collecting toner container 10 for about 8 seconds or so regardless of the shape of the discharge opening 24 of the collecting toner container 10.

The second step is a step of separating the components from the main body of the collecting toner container 10. About 4 seconds are necessary for the separation of each component from the main body of the collecting toner container 10. Thus, when the lid member 22*a* and the collecting toner amount detector 12 are separate components, about 8 seconds (=4 seconds×two components) are necessary.

In the third step, as illustrated in FIG. 8A, the lid member 22*a* and the collecting toner amount detector 12 are integrated with each other. Then, as illustrated in FIG. 5B, the first discharge opening 5 having a large opening area is formed by the connection of the discharge opening 24 and the opening 25. In that case, about 35 seconds were necessary for discharging all collecting toner t inside the collecting toner container 10. Meanwhile, when only the discharge opening 24 is formed as an opening communicating with the inside of the collecting toner container 10, about 120 seconds were necessary for discharging all collecting toner t inside the collecting toner container 10.

In the fourth step, as illustrated in FIG. 8A, the lid member 22*a* and the collecting toner amount detector 12 are integrated with each other. Then, as illustrated in FIG. 5B, the first discharge opening 5 having a large opening area is formed by the connection of the discharge opening 24 and the opening 25. In that case, about 91 seconds were necessary for cleaning the inside of the collecting toner container 10. Meanwhile, when only the discharge opening 24 is formed as an opening communicating with the inside of the collecting toner container 10, about 300 seconds were necessary for cleaning the inside of the collecting toner container 10.

In the fifth step, similarly to the second step, a separate working time is necessary depending on the number of components attached to the main body of the collecting toner container 10, and about 4 seconds were necessary for the attachment of each component.

Here, a case will be considered in which the discharge opening 24 is provided only in the side surface of the collecting toner container 10 in the long-side direction (the left and right direction of FIG. 5A). Further, as illustrated in FIG. 5B, the discharge opening 24 provided in the side surface of the collecting toner container 10 in the long-side direction (the left and right direction of FIG. 5B) is connected to the opening 25 provided in the lower surface of the collecting toner container 10 to be equipped with the collecting toner amount detector 12. Accordingly, a case will be considered in which the first discharge opening 5 having a large opening area is formed.

Compared with the case where only the discharge opening 24 is provided in the collecting toner container 10, the discharging efficiency for the collecting toner t inside the collecting toner container 10 could be improved when the first discharge opening 5 having a large opening area is formed.

Further, the working time necessary for cleaning the inside of the collecting toner container 10 of the fourth step can be shortened when the time necessary for discharging the collecting toner t from the discharge opening 24 in the third step is short, and hence the working efficiency is improved. In the embodiment, as illustrated in FIG. 5B, the first discharge opening 5 having a large opening area is formed by the connection of the discharge opening 24 and the opening 25.

Accordingly, since it was possible to decrease the amount of the collecting toner t staying inside the collecting toner container 10, the time necessary for discharging the collecting toner t in the third step is short, and the working time necessary for cleaning the inside of the collecting toner container 10 in the fourth step can be shortened. As a result, the working efficiency was improved.

In the embodiment, as illustrated in FIG. 8A, the collecting toner amount detector 12 detecting the collecting toner amount inside the collecting toner container 10 is integrated with the lid member 22*a* blocking the discharge opening 24. Accordingly, it is possible to simultaneously separate the collecting toner amount detector 12 and the lid member 22*a* that need to be separated from the main body of the collecting toner container 10 when the collecting toner container 10 is cleaned so as to reuse the collecting toner container 10. Accordingly, the cleaning work efficiency for the collecting toner container 10 can be improved.

Further, as illustrated in FIG. 5B, the first discharge opening 5 having a large opening area is formed by the connection of the discharge opening 24 and the opening 25 used to attach the collecting toner amount detector 12 thereto. Accordingly, the discharging work and the cleaning work for the collecting toner t can be efficiently performed.

For example, a case will be considered in which the discharge opening 24 as a comparative example is provided only in one surface of the collecting toner container 10. The discharge time was compared while the total opening area of the discharge opening 24 provided in the side surface of the collecting toner container 10 and the opening 25 provided in the lower surface of the collecting toner container 10 of the embodiment was set to be equal to the opening area of the discharge opening 24 of the comparative example. As a result, in the embodiment in which the collecting toner t was collected in two surfaces of the collecting toner container 10 during the discharge of the collecting toner t, the discharge time was shorter than the comparative example in which the collecting toner was collected in one surface of the collecting toner container 10. Thus, it was proved that the discharging efficiency of the embodiment was improved.

Further, in the embodiment, an example of a case has been described in which the collecting toner amount detector 12 is provided in the lower surface of the collecting toner container 10, but the invention is not limited thereto. For example, the collecting toner amount detector may be provided in the other surface of the collecting toner container 10.

Second to Fourth Embodiments

Figure 7A:
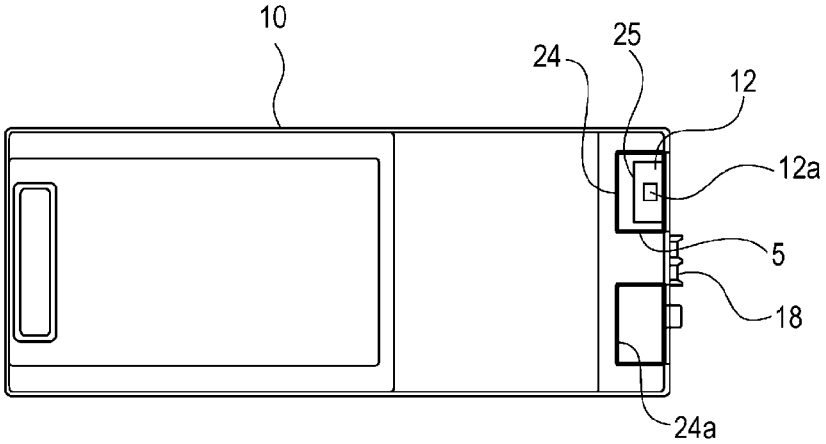
FIG. 7A is a bottom view illustrating the configuration in the periphery of a discharge opening of a collecting toner container according to a second embodiment of the invention.
Figure 7B:
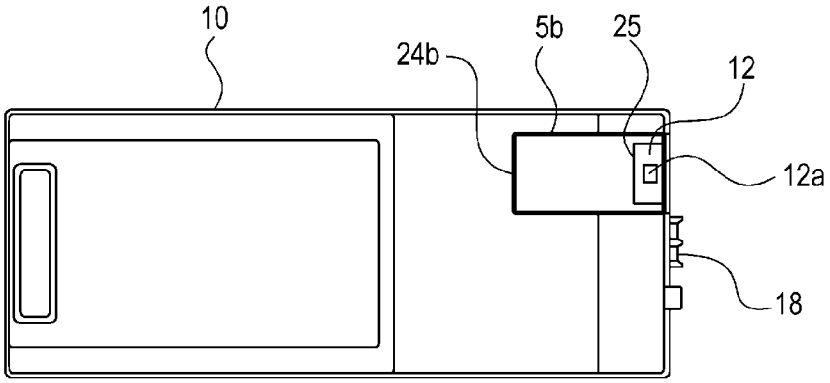
FIG. 7B is a bottom view illustrating the configuration in the periphery of a discharge opening of a collecting toner container according to a third embodiment of the invention.
Figure 7C:
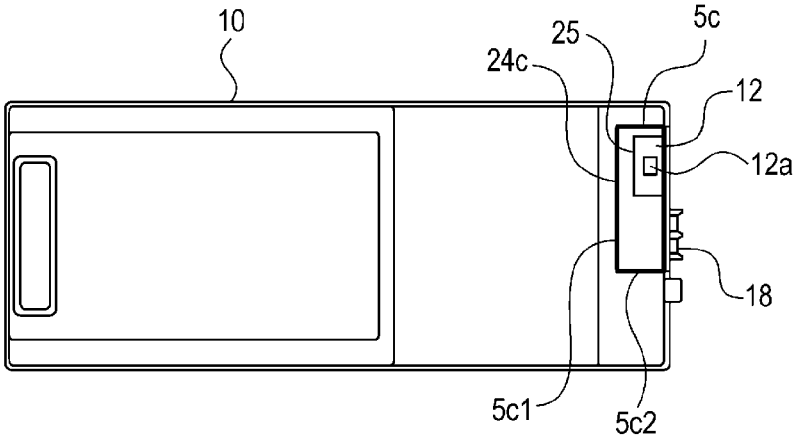
FIG. 7C is a bottom view illustrating the configuration in the periphery of a discharge opening of a collecting toner container according to a fourth embodiment of the invention.

Next, the configurations of collecting toner containers according to second to fourth embodiments of the invention will be described with reference to FIGS. 7A to 7C and FIGS. 8A to 8C. In addition, the same reference numeral or the same name having a different reference numeral will be given to the component having the same configuration as the first embodiment, and the description thereof will not be repeated. FIGS. 7A to 7C are bottom views illustrating the collecting toner containers 10 according to the second to fourth embodiments.

Figure 8B:
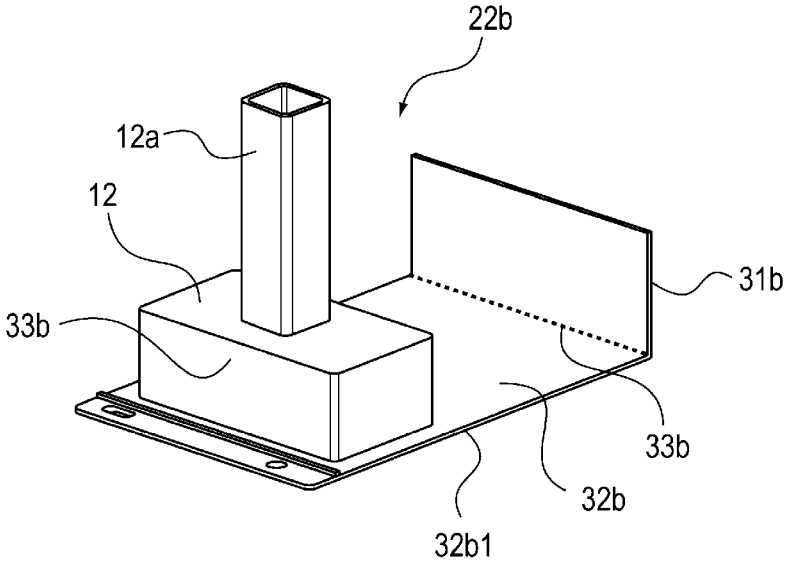
FIG. 8B is a perspective view illustrating the configuration of a lid member of the collecting toner container according to the third embodiment of the invention.
Figure 8C:
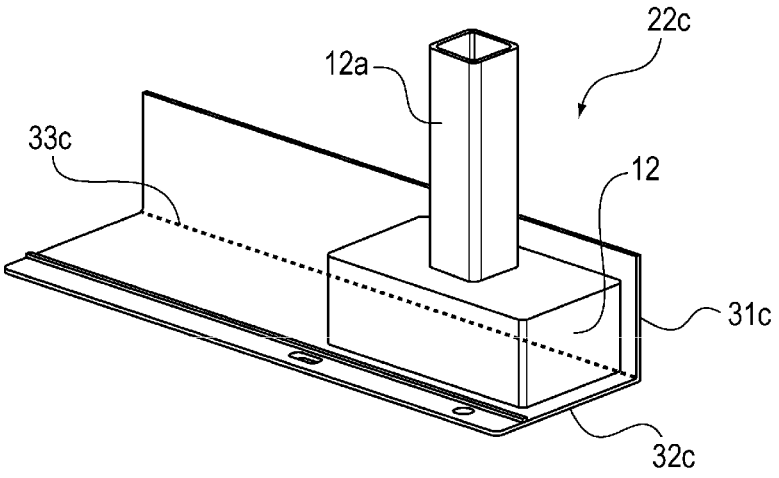
FIG. 8C is a perspective view illustrating the configuration of a lid member of the collecting toner container according to the fourth embodiment of the invention.

FIGS. 8A to 8C are perspective views illustrating the configurations of the lid members 22*a* to 22*c* integrated with the collecting toner amount detector 12 detecting the collecting toner amount inside the collecting toner container 10.

As illustrated in FIGS. 7A to 7C, discharge openings 24, 24*a*, 24*b*, and 24*c* (second openings) are respectively provided in the side surfaces of the collecting toner containers 10 of the second to fourth embodiments in the long-side direction (the left and right direction of FIGS. 7A to 7C). The side surface of the collecting toner container 10 provided with each of the discharge openings 24, 24*a*, 24*b*, and 24*c* (the second openings) is formed as a wall surface slightly close to the center in relation to the wall surface 10*b* as the outermost surface of the collecting toner container 10. The collecting toner t inside the collecting toner container 10 is discharged from each of the discharge openings 24, 24*a*, 24*b*, and 24*c*.

Then, the lower surface of the collecting toner container 10 is provided with the opening 25 (the first opening) to which the collecting toner amount detector 12 is attached. Then, the first discharge openings 5, 5*b*, and 5*c* illustrated in FIGS. 7A to 7C and each having a large opening area are formed by the connection of the discharge openings 24, 24*b*, and 24*c* with respect to the opening 25. Then, the lid members 22*a* to 22*c* illustrated in FIGS. 8A to 8C are provided so as to respectively block the first discharge openings 5, 5*b*, and 5*c*.

The openings 25 (the first openings) illustrated in FIGS. 7A to 7C respectively used to attach the collecting toner amount detectors 12 of the collecting toner containers 10 of the second to fourth embodiments thereto and the discharge openings 24, 24*b*, and 24*c* (the second openings) used to discharge the collecting toner t have the following configuration. The openings are respectively provided in two adjacent surfaces of the collecting toner container 10, that is, the lower surface and the side surface (the wall surface slightly close to the center in relation to the wall surface 10*b* as the outermost surface of the collecting toner container 10). The first discharge openings 5, 5*b*, and 5*c* each having a large opening area are formed by the connection of the discharge openings 24, 24*b*, and 24*c* with respect to the opening 25 are respectively blocked by the lid members 22*a* to 22*c* illustrated in FIGS. 8A to 8C.

In the second embodiment illustrated in FIGS. 7A and 8A, the discharge opening 24*a* (the second opening) is provided in addition to the discharge opening 24 (the second opening) of the first embodiment. The discharge opening 24*a* is provided in the side surface of the collecting toner container 10 (the wall surface slightly close to the center in relation to the wall surface 10*b* as the outermost surface of the collecting toner container 10) in the long-side direction (the left and right direction of FIG. 7A). The discharge opening 24*a* is provided in the short-side direction of the collecting toner container 10 (the up and down direction of FIG. 7A). The discharge opening 24*a* communicates with the inner space of the collecting toner container 10 and discharges the collecting toner t inside the collecting toner container 10 therethrough.

The discharge opening 24*a* can be blocked by the lid member 22*a* having an L-shaped cross-section in which the collecting toner amount detector 12 is removed from the lid member 22*a* illustrated in FIG. 8A.

In the collecting toner container 10 of the third embodiment illustrated in FIG. 7B, the discharge opening 24*b* (the second opening) is provided in the side surface of the collecting toner container 10 (the wall surface slightly close to the center in relation to the wall surface 10*b* as the outermost surface of the collecting toner container 10) in the long-side direction (the left and right direction of FIG. 7B). The discharge opening 24*b* communicates with the inner space of the collecting toner container 10 and discharges the collecting toner t inside the collecting toner container 10.

The discharge opening 24*b* is disposed so as to extend leftward in FIG. 7B in relation to the discharge opening 24 illustrated in FIG. 7A in the long-side direction of the collecting toner container 10 (the left and right direction of FIG. 7B). Then, the first discharge opening 5*b* having a large opening area is formed by the connection of the discharge opening 24*b* and the opening 25.

The first discharge opening 5*b* illustrated in FIG. 7B is formed so that the opening area is widened in the long-side direction of the collecting toner container 10 (the left and right direction of FIG. 7B) in relation to the first discharge opening 5 having a large opening area formed by the connection of the discharge opening 24 and the opening 25 of the first embodiment illustrated in FIG. 5B.

In the collecting toner container 10 according to the fourth embodiment illustrated in FIG. 7C, the discharge opening 24*c* (the second opening) is provided in the side surface of the collecting toner container 10 (the wall surface slightly close to the center in relation to the wall surface 10*b* as the outermost surface of the collecting toner container 10) in the long-side direction (the left and right direction of FIG. 7C). The discharge opening 24*c* communicates with the inner space of the collecting toner container 10 and discharges the collecting toner t inside the collecting toner container 10.

The discharge opening 24*c* is disposed so as to extend downward in FIG. 7C in relation to the discharge opening 24 illustrated in FIG. 7A in the short-side direction of the collecting toner container 10 (the up and down direction of FIG. 7C). Then, the first discharge opening 5*c* having a large opening area is formed by the connection of the discharge opening 24*c* and the opening 25.

The first discharge opening 5*c* illustrated in FIG. 7C is formed so that the opening area is widened in the short-side direction of the collecting toner container 10 (the up and down direction of FIG. 7C) in relation to the first discharge opening 5 having a large opening area formed by the connection of the discharge opening 24 and the opening 25 of the first embodiment illustrated in FIG. 5B.

An edge 5*c*1 of the first discharge opening 5*c* illustrated in FIG. 7C in the short-side direction of the collecting toner container 10 (the up and down direction of FIG. 7C) is set to be longer than an edge 5*c*2 of the first discharge opening 5*c* in the long-side direction of the collecting toner container 10 (the left and right direction of FIG. 7C).

The discharge opening 24*c* (the second opening) of the first discharge opening 5*c* of the collecting toner container 10 according to the fourth embodiment illustrated in FIG. 7C extends to the position of the stirring/conveying member 15 as the conveying portion.

An actual measured value for the working time in which the collecting toner t is discharged from each of the first discharge openings 5, 5*b*, and 5*c* of the collecting toner containers 10 of the second to fourth embodiments illustrated in FIGS. 7 and 8 in the third step will be described below. In addition, the openings 25 illustrated in FIGS. 7A to 7C have the same area. Further, the discharge openings 24, 24*a*, and 24*b* illustrated in FIGS. 7A to 7C have the same area. Further, the area of the discharge opening 24*c* illustrated in FIG. 7C is equal to the total area of the area of the discharge opening 24 and the area of the discharge opening 24*a* illustrated in FIG. 7A.

In the collecting toner container 10 illustrated in FIG. 7A, another discharge opening 24*a* is further provided in addition to the first discharge opening 5 having a large opening area formed by the connection of the discharge opening 24 and the opening 25 of the first embodiment illustrated in FIG. 5B. In the collecting toner container 10 illustrated in FIG. 7A, the time necessary for discharging the collecting toner t in the third step was about 27 seconds.

In the collecting toner container 10 illustrated in FIG. 7B, the time necessary for discharging the collecting toner t in the third step was about 14 seconds.

In the collecting toner container 10 illustrated in FIG. 7C, the time necessary for discharging the collecting toner t in the third step was about 13 seconds.

In the first embodiment illustrated in FIG. 5B, the time necessary for discharging the collecting toner t in the third step was about 35 seconds. According to the comparison with the first embodiment illustrated in FIG. 5B, the time necessary for discharging the collecting toner t in the third step could be shortened in any one of the collecting toner containers 10 illustrated in FIGS. 7A to 7C.

Particularly, the opening area of the first discharge opening 5 of the collecting toner container 10 can be widen in the long-side direction (the left and right direction of FIG. 7B) similarly to the first discharge opening 5*b* illustrated in FIG. 7B.

Further, the first discharge opening 5 of the collecting toner container 10 can be widen in the short-side direction (the up and down direction of FIG. 7C) similarly to the first discharge opening 5*c* illustrated in FIG. 7C.

Next, the configurations of the lid members 22*a* to 22*c* respectively blocking the first discharge openings 5, 5*b*, and 5*c* of the collecting toner containers 10 illustrated in FIGS. 7A to 7C will be described with reference to FIGS. 8A to 8C. Each of the lid members 22*a* to 22*c* illustrated in FIGS. 8A to 8C is integrated with the collecting toner amount detector 12.

The lid members 22*a* to 22*c* illustrated in FIGS. 8A to 8C respectively block the first discharge openings 5, 5*b*, and 5*c* connected to the lower surface of the collecting toner container 10 and one side surface of the collecting toner container 10 in the long-side direction (the left and right direction of FIGS. 7A to 7C). Each of the lid members 22*a* to 22*c* has an L-shaped cross-section by the side surface plates 31*a* to 31*c* and the bottom surface plates 32*a* to 32*c*.

Each of edges 33*a* to 33*c* is formed in the short-side direction of the collecting toner container 10 (the up and down direction of FIGS. 7A to 7C) so as to be located between each of the side surface plates 31*a* to 31*c* and each of the bottom surface plates 32*a* to 32*c*.

In the lid member 22*b* illustrated in FIG. 8B and used to block the first discharge opening 5*b* of the collecting toner container 10 illustrated in FIG. 7B, an edge 32*b*1 of the bottom surface plate 32*b* perpendicular to an edge 33*b* forming an L-shaped cross-section becomes the longest edge.

In the lid member 22*c* illustrated in FIG. 8C and used to block the first discharge opening 5*c* of the collecting toner container 10 illustrated in FIG. 7C, the side surface plate 31*c* and the bottom surface plate 32*c* forming an L-shaped cross-section extends along the edge 33*c*.

When the collecting toner t is charged into the collecting toner containers 10 illustrated in FIGS. 7A to 7C, a force generated by the gravity acting on the collecting toner t in a direction from the rear side to the front side of the drawing paper of FIGS. 7A to 7C is applied to the lid members 22*a* to 22*c* in the gravity direction. As illustrated in FIG. 8C, when the gravity of the collecting toner t is taken into consideration, the lid member 22*c* has strong rigidity when the side surface plate 31*c* and the bottom surface plate 32*c* forming an L-shaped cross-section in the lid member 22*c* are extended in the short-side direction of the collecting toner container 10 (the up and down direction of FIG. 7C).

Accordingly, it is possible to prevent the collecting toner t from leaking from the discharge opening 24*c* without bending the lid member 22*c* by the gravity of the collecting toner t.

Further, the discharge opening 24*c* illustrated in FIG. 7C can extend to the position of the stirring/conveying member 15 illustrated in FIG. 4 when the discharge opening 24*c* extends in the short-side direction of the collecting toner container 10 (the up and down direction of FIG. 7C).

There is a case in which the collecting toner t adheres to the seal member 20 illustrated in FIG. 4 when the collecting toner t is discharged in the third step to clean the collecting toner container 10. In this case, since the discharge opening 24*c* illustrated in FIG. 7C extends to the position of the stirring/conveying member 15 illustrated in FIG. 4, the periphery of the seal member 20 illustrated in FIG. 4 is easily cleaned. Since the other configurations are the same as those of the first embodiment, the same effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-249463, filed Dec. 10, 2014, which is hereby incorporated by reference herein in its entirety.

What is claimed is:

1. A collecting toner container detachably attachable to an image forming apparatus so as to collect toner, the collecting toner container comprising:

a storage portion that collects and stores the toner;

an inflow opening through which the toner flows from the image forming apparatus to the storage portion;

a conveying member that conveys the toner inside the storage portion;

a discharge opening that is provided in the storage portion, the toner stored in the storage portion being discharged from the container through the discharge opening by an operation of an operator; and a lid member detachably attached to the container at a portion corresponding to the discharge opening, the lid member being configured to close the discharge opening when the lid member is attached to the container and configured to expose the discharge opening when the lid member is detached from the container, the lid member comprising a detecting container in which the toner is detected, wherein the toner conveyed inside the storage portion flows into an inner space of the detecting container when the lid member is attached to the container and the container is attached to the image apparatus.

2. The collecting toner container according to claim 1, wherein the discharge opening is disposed at a position across both a part of a lower surface of the container and a part of a side surface of the container.

3. The collecting toner container according to claim 1, wherein the detecting container is formed as a transparent container, and the detecting container protrudes toward outside of the container.

4. An image forming apparatus detachably attached to the collecting toner container according claim 3, the image forming apparatus comprising:

a detector including a light emitting portion and a light receiving portion, wherein, in a case that the collecting toner container is attached to the image forming apparatus, the detecting container is disposed in a light path between the light receiving portion and the light emitting portion.

5. The collecting toner container according to claim 1, wherein the collecting toner container has an almost rectangular shape and the conveying member that conveys the toner is disposed so as to convey the toner from one end to the other end of the container in a longitudinal direction when the conveying member attached to the image forming apparatus is viewed from a vertical upper position.

6. The collecting toner container according to claim 5, wherein the inflow opening is disposed at the one end side of an upper surface of the container in the longitudinal direction.

7. The collecting toner container according to claim 5, wherein the discharge opening is disposed at the other end side of a lower surface of the container in the longitudinal direction.

* * * * *